US006508366B2

(12) United States Patent
Danger et al.

(10) Patent No.: US 6,508,366 B2
(45) Date of Patent: Jan. 21, 2003

(54) HYDROCYCLONE DEVICE FOR CLEANING A FLUID

(75) Inventors: Michael Danger, Salem (DE); Rolf Hartmann, Weingarten (DE); Stefan Rippl, Ravensburg (DE); Peter Schweiss, Elchingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/863,259

(22) Filed: May 24, 2001

(65) Prior Publication Data

US 2001/0052486 A1 Dec. 20, 2001

(30) Foreign Application Priority Data

Jun. 20, 2000 (DE) ..... 200 10 900 U

(51) Int. Cl.[7] ..... B04C 5/24; F16L 23/00

(52) U.S. Cl. ..... 209/725; 209/728; 210/512.2; 285/406; 285/410

(58) Field of Search ..... 209/725, 728, 209/729; 210/512.1, 512.2, 787; 285/108, 109, 125, 405–408, 410

(56) References Cited

U.S. PATENT DOCUMENTS

| | | | | | |
|---|---|---|---|---|---|
| 3,085,382 A | | 4/1963 | Finney et al. | ..... | 55/449 |
| 4,146,469 A | | 3/1979 | Kaiser et al. | ..... | 209/728 |
| 4,655,923 A | * | 4/1987 | Leone | ..... | 209/728 X |
| 5,401,411 A | | 3/1995 | Andersson | ..... | 210/512.2 |
| 5,944,985 A | * | 8/1999 | Bowman | ..... | 285/179 X |
| 6,003,537 A | * | 12/1999 | Bravo | ..... | 285/133.21 X |

FOREIGN PATENT DOCUMENTS

| | | | | |
|---|---|---|---|---|
| DE | 3150073 | | 6/1983 | |
| DE | 29916596 | | 2/2000 | |
| SU | 1570786 | * | 6/1990 | ..... 209/728 |
| WO | 91/16988 | | 11/1991 | |

* cited by examiner

*Primary Examiner*—Tuan N. Nguyen
(74) *Attorney, Agent, or Firm*—Greenblum & Bernstein, P.L.C.

(57) ABSTRACT

Hydrocyclone device including at least one hydrocyclone having at least one feeding connector, at least one accepted stock connector, and at least one rejected stock connector. The device also includes at least one distribution and collection device arranged for feeding fluids into and removing fluids from the at least one hydrocyclone, and at least one flange coupled to at least one of the at least one feeding connnector, the at least one accepted stock connector, and the at least one rejected stock connector, which is removably couplable to the at least one distribution and collection device.

33 Claims, 3 Drawing Sheets

HYDROCYCLONE DEVICE FOR CLEANING A FLUID

CROSS-REFERENCE TO RELATED APPLICATIONS

The present application claims priority under 35 U.S.C. §119 of German Patent Application No. DE 200 10 900.6, filed on Jun. 20, 2000, the disclosure of which is expressly incorporated by reference herein in its entirety.

BACKGROUND OF THE INVENTION

1. Field of the Invention

The invention relates to a hydrocyclone device which includes several hydrocyclones.

2. Discussion of Background Information

It is known that hydrocyclones are used to fraction fluids, containing particles of different sinking characteristics, using strong centrifugal forces. It is possible, for instance, to concentrate the contaminants contained in a fibrous suspension, as used for the production of paper, and to guide them out of the hydrocyclone by a rejected stock connector. The fraction cleared of contaminants, namely the accepted stock, is guided through the accepted stock connector and is used further. These procedures are known per se as well as the fact that a positive effect is only ensured when the hydrocyclones do not exceed a certain size. In a hydrocyclone device made for greater amounts of throughput, sometimes several, frequently even many, hydrocyclones are necessary. In this manner, the hydrocyclones are flowed through in a parallel manner by the fluids to be cleaned, i.e., the fluid flow must be divided into a multitude of smaller partial flows. Accordingly, for instance, distribution and collection devices can be used as described in the following.

A useful distribution and collection device must generally be designed such that the fluid flows are distributed as evenly as possible. Additionally, hydraulic disturbances, vortexes, or the like should be avoided. Another requirement for hydrocyclone devices of this type is their simplicity for allowing an inexpensive production. Additionally, the hydrocyclones should be easy to exchange for maintenance purposes. These demands have not been fulfilled satisfactorily by the devices available up to now.

SUMMARY OF THE INVENTION

The present invention provides a hydrocyclone device with simple elements designed such that the hydrocyclones can easily be mounted and dismounted and that a secure fixing is ensured even in the case of excessive pressure.

In the hydrocyclone device of the instant invention, at least one of the connectors of the hydrocyclones, e.g., feeding connector, accepted stock connector, and rejected stock connector, is provided with a flange which is mounted onto a distribution and collection device. In a preferred embodiment, the flange can be screwed onto the distribution and collection device with the aid of threaded bolts which are mounted to a wall of the distribution and collection device.

The distribution and collection device designed according to the invention contains, for the influx and for the outflow, one relatively large cylindrical metal pipe each or an oval metal flow piece. The above-mentioned threaded bolts can easily be mounted, e.g., welded, thereto. For a screwed connection, only a few and also cheap norm pieces are necessary. Due to the fact that hydrocyclones are produced in series, e.g., are molded or injected, the flanges can be produced in one piece with the connectors.

The present invention is directed to a hydrocyclone device that includes at least one hydrocyclone having at least one feeding connector, at least one accepted stock connector, and at least one rejected stock connector. The device also includes at least one distribution and collection device arranged for feeding fluids into and removing fluids from the at least one hydrocyclone, and at least one flange coupled to at least one of the at least one feeding connector, the at least one accepted stock connector, and the at least one rejected stock connector, which is removably couplable to the at least one distribution and collection device.

In accordance with a feature of the instant invention, the at least one flange can be removably couplable to the at least one distribution and collection device via threaded bolts.

Further, the at least one distribution and collection device can include a wall, and the at least one flange may be screwed onto the at least one distribution and collection device via threaded bolts mounted to the wall.

Moreover, threaded bolts can be welded to a wall of the at least one distribution and collection device. The wall is not provided with any reinforcements or bores at welding points.

Two threaded bolts can be associated with at least each of the at least one accepted stock connector and the feeding connector and can be mounted to a wall of the at least one distribution and collection device at point having a shortest distance from the at least one flange.

According to another feature of the instant invention, at least one seal may be arranged to surround one of the at least one accepted stock connector and the feeding connector. The at least one seal may be insertable into the at least one distribution and collection device such that a portion of the at least one seal is located inside the at least one distribution and collection device and a portion of the at least one seal is located outside of the at least one distribution and collection device. Further, an outer diameter of the portions of the at least one seal is greater than a diameter of an opening in a wall of the at least one distribution and collection device through which the at least one seal is inserted. Moreover, another portion of the at least one seal, which is positionable in the opening of the wall, can have an outer diameter at least about 2 mm smaller than the diameter of the opening. The at least one seal can include a bore, and bore may have a cone shape that narrows in an insertion direction.

In accordance with still another feature of the invention, the flange may have a disk surface which, in its mounted position, is not in contact with the at least one seal.

Further, at least two of the connectors of the at least one hydrocyclone may be positionably adjustable relative to each other and positionably fixable.

A central axis of the at least one hydrocyclone can be arranged substantially perpendicularly to a main flow direction in the at least one distribution and collection device.

Still further, the at least one distribution and collection device can include a flow part formed by a closed side wall with openings arranged to receive the at least one feeding connector and one of the at least one accepted stock connector and the rejected stock connector, and a separation wall positioned inside the closed side wall to seal a flow cross section. The at least one feeding connector may be arranged upstream of the separation wall, relative to a main flow direction, and the one of the at least one accepted stock connector and the at least one rejected stock connector may be arranged downstream of the separation wall, relative to the main flow direction. The openings for the one of the at least one accepted stock connector and the at least one rejected stock connector can be evenly distributed over a circumference of the at least one distribution and collection device. Further, a central axis of the at least one hydrocyclone may be positioned parallel to the main flow direction. The side wall can have a cross-section of a regular polygon.

In accordance with a further feature of the present invention, the at least one hydrocyclone may include a plurality of hydrocyclones, in which each of the plurality of hydrocyclones include at least one feeding connector, at least one accepted stock connector, and at least one rejected stock connector. Moreover, the at least one distribution and collection device may include at least one feeding pipe, arranged to feed fluids to be cleaned to the plurality of hydrocyclones, and at least one accepted stock pipe, arranged to remove accepted stock from the plurality of hydrocyclones.

The at least one flange may include a plurality of flanges which are removably couplable to the at least one distribution and collection device, and one of the plurality of flanges may be mounted to each of the at least one feeding connector and at least one accepted stock connector. Two threaded bolts may be coupled to the at least one distribution and collection device to mount each of the plurality of flanges.

According to a still further feature of the invention, the at least one flange may have a round disk shape. Moreover, the at least one flange may have an oval shape. Still further, the at least one flange can include a plurality of flanges, and the flanges can have different shapes. Alternatively, the at least one flange can include a plurality of flanges, and the flanges can have same shapes.

In accordance with yet another feature of the instant invention, the at least one distribution and collection device can include at least one feeding pipe, arranged to feed fluids to be cleaned to the plurality of hydrocyclones, and at least one accepted stock pipe, arranged to remove accepted stock from the plurality of hydrocyclones.

The at least one feeding pipe and the at least one accepted stock pipe may be aligned one above the other, and the at least one feeding pipe can be arranged below the at least one accepted stock pipe. Further, stock can flow out of the at least one feeding pipe in a direction substantially parallel to a direction at which stock flows into the at least one accepted stock. Still further, stock can flow out of the at least one feeding pipe in a direction substantially perpendicular to a direction at which stock flows into the at least one accepted stock.

The present invention is directed to an apparatus for cleaning a fluid that includes a plurality of hydrocyclones, in which each hydrocyclone includes a feeding connector and an accepted stock connector. A feed pipe is provided for supplying the fluid to be cleaned, and an accepted stock pipe is provided for removing the cleaned fluid. Flanges are coupled to the feeding connector and to the accepted stock connector. The flanges are removably couplable to the feed pipe and to the accepted stock pipe.

In accordance with yet another feature in accordance with the instant invention, the feed pipe and the accepted stock pipe can include walls, and the apparatus may further include threaded bolts mounted to the walls. The flanges may be removably couplable to the threaded bolts. Further, each hydrocyclone can further include a rejected stock connector, and the apparatus can further include a rejected stock pipe coupled to the rejected stock connector.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
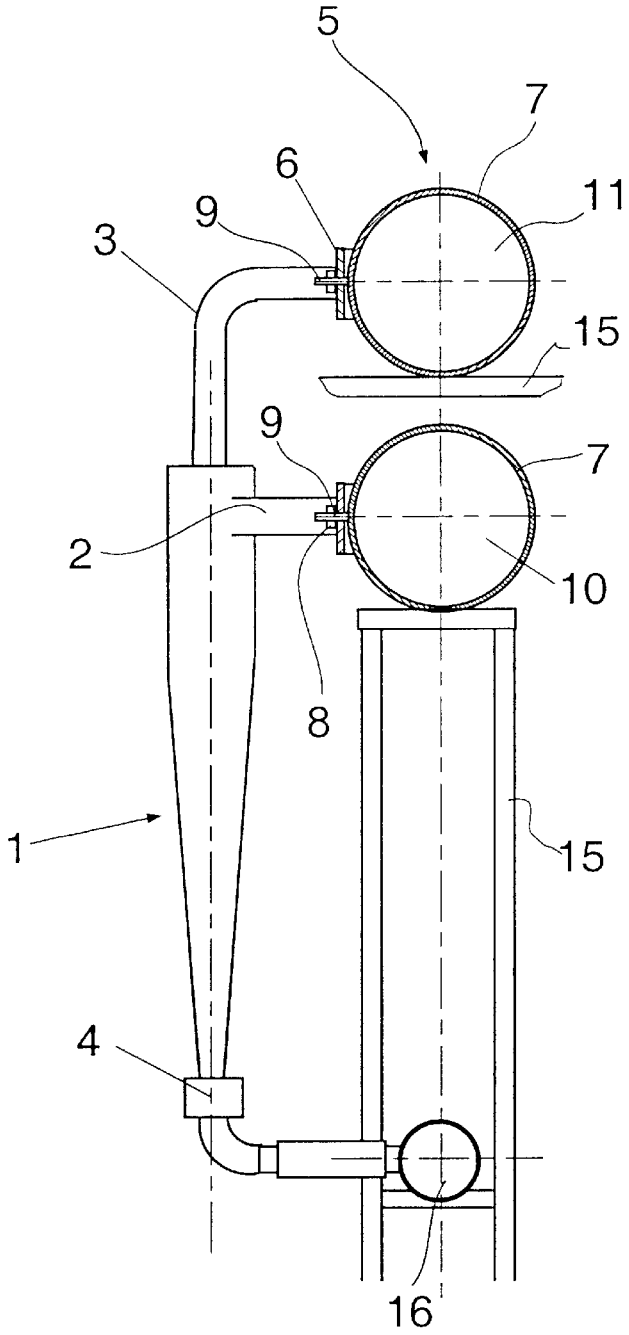
FIG. 1 illustrates a side view of a part of a hydrocyclone device in accordance with the instant invention.

FIG. 1 illustrates a hydrocyclone 1 in an exemplary manner which is connected to a distribution and collection device 5 in accordance with the features of the present invention to form a part of a hydrocyclone device. It is noted that a plurality of hydrocyclones 1 can be advantageously coupled to distribution and collection device 5 in the manner depicted in the exemplary illustration. Distribution and collection device 5 includes a feeding pipe 10 and an accepted stock pipe 11. When the hydrocyclone device is in operation, fluid to be cleaned travels into hydrocyclone 1 from feeding pipe 10, which is positioned below accepted stock pipe 11 in the illustrated embodiment, through a feeding connector 2. After the desired cleaning, the fluid flows into an accepted stock connector 3 and subsequently into accepted stock pipe 11 which is positioned above feeding pipe 10. Feeding connector 2 and accepted stock connector 3 are each provided with a flange 6' and 6 which is detachably mounted to a cylindrical side wall 7 of the respective pipes 11 and 10. Flanges 6 and 6' are preferably mounted to side walls 7 with threaded bolts 9 and nuts 8. As is conventional in the art, rejected stock connector 4 is provided at a lower end of hydrocyclone 1 and serves to remove the heavy particles collected in hydrocyclone 1 into a reject collection pipe 16. Advantageously, the connector at rejected stock collector pipe 16 is arranged parallel to the other connectors. A mounting frame 15 (schematically depicted) is provided to serve as a fixing device for the parts of distribution and collection device 5. Hydrocyclones 1 are already mounted sufficiently tightly by the above-described connections.

Figure 2:
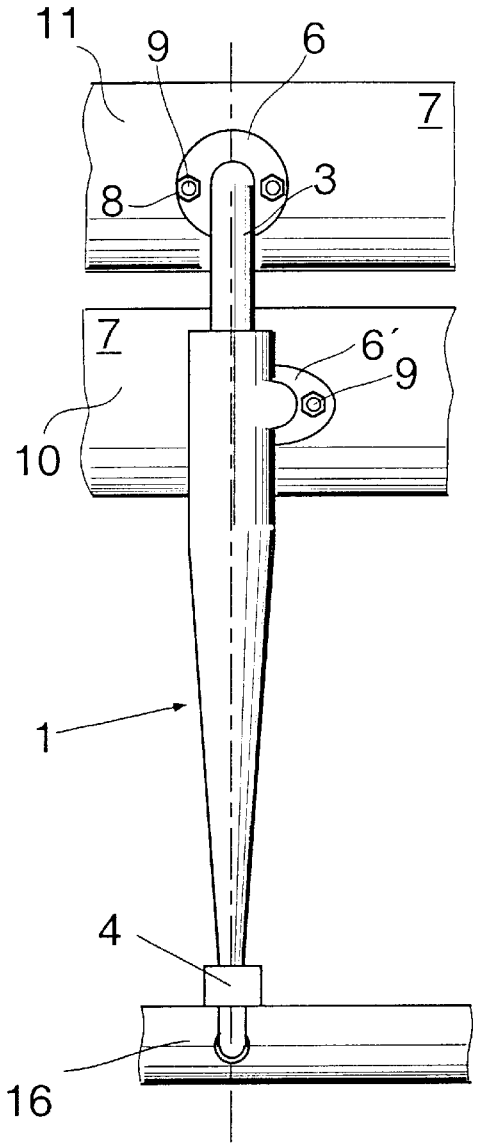
FIG. 2 illustrates another side view of the part of the hydrocyclone device depicted in FIG. 1.

Another side view of the part of the hydrocyclone device depicted in FIG. 1 is illustrated in FIG. 2. Feeding pipe 10 and accepted stock pipe 11, as well as distribution and collection device 5 and flanges 6 and 6' are discernible in this side view. Flange 6 connected to upper pipe 11 is, e.g., a round flange, while corresponding flange 6' connected to feeding pipe 10 is, e.g., an oval shape. However, it is also contemplated that the flange shapes may be the same, other shapes, or even reversed from that shown in FIG. 2. In general, two threaded bolts 9 should be sufficient to attach flange 6 or 6' to respective pipes 11 or 10. Moreover, it can be advantageous to weld threaded bolts 9 onto cylindrical side wall 7 once the construction of the hydrocyclone device begins, since possible unevennesses of the piping can then be leveled. Another advantage of the construction in accordance with the instant invention is that no additional expense such as drilling or fixing of reinforcements are necessary here. Each threaded bolt 9 can be set onto the bent or curved pipe wall 7 and welded to it.

Figure 3:
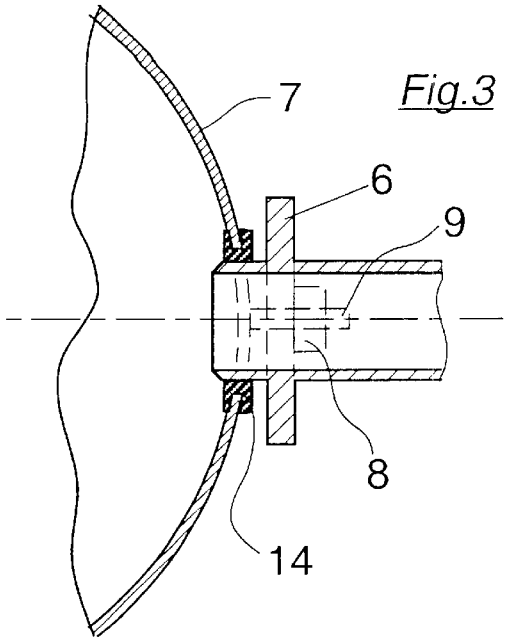
FIG. 3 illustrates a connector in accordance with the instant invention.
Figure 4:
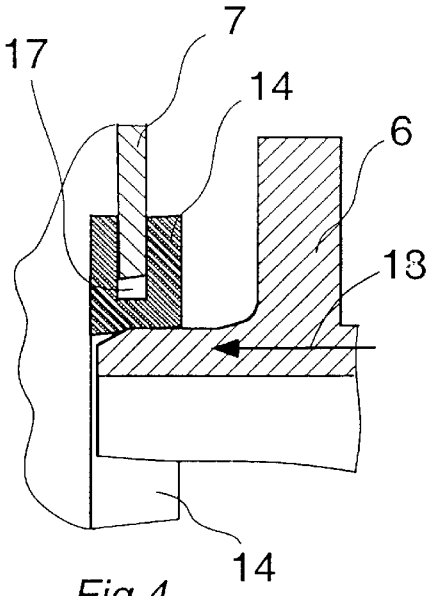
FIG. 4 illustrates a seal in accordance with the instant invention.

It may be particularly useful to connect flanges 6 or 6' to distribution and collection device 5 according to the illustrations of exemplary FIG. 3 and/or FIG. 4. In this manner, an elastic seal 14 can be inserted through an opening in cylindrical side wall 7. Threaded bolt 9 and nuts 8 are illustrated in dot-dash lines in FIG. 3 because they are hidden. Inside and outside of the cylindrical wall 7 of feeding pipe 10 and/or of removal (accepted stock) pipe 11, seal 14 has a larger exterior diameter than the diameter of the opening in cylindrical wall 7. An exterior diameter of a part of seal 14, which is to be positioned in the opening of cylindrical wall 7 after its insertion, is smaller than a diameter of the opening. Thus, initially an intermediate space 17, as depicted in FIG. 4, is formed, which remains until the connection of hydrocyclone into its final position. A bore of seal 14 can be formed to be substantially cone-shaped such that it narrows from the outside toward the inside, i.e., in a mounting direction 18 of flange 6. Thus, seal 14 is widened during insertion of the connecting pipe and contacts the interior of the distribution pipe. In this way, tolerances, which cannot be completely excluded, can be compensated during the production of hydrocyclone 1 and/or the hydrocyclone device.

Figure 5:
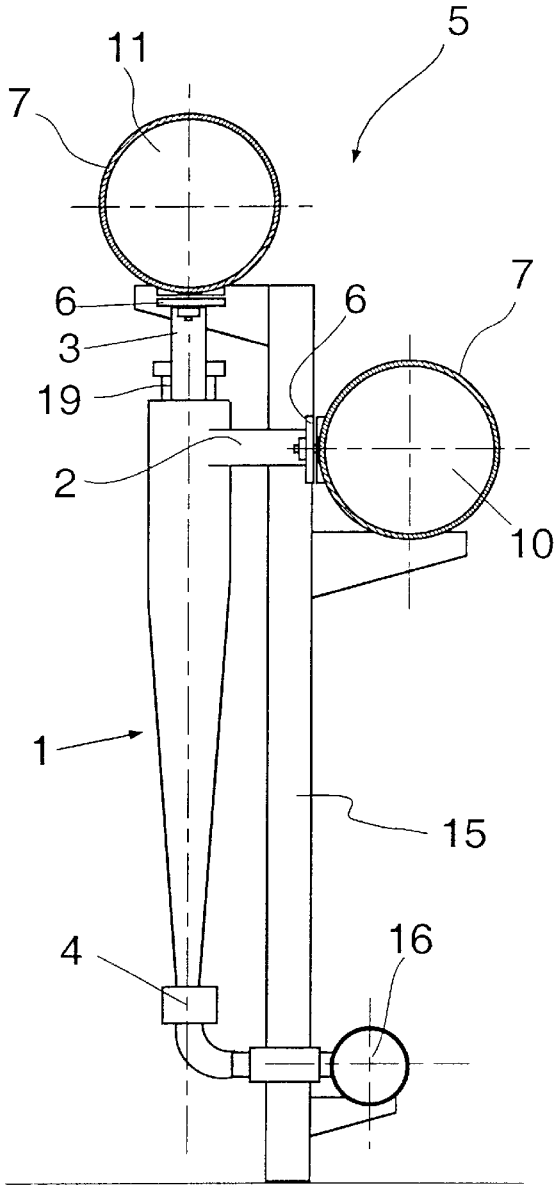
FIGS. 5 and 6 illustrate alternative embodiments of the instant invention.

In the hydrocyclone device illustrated in FIG. 5, distribution and collection pipes 5, i.e., feeding pipe 10 and accepted stock pipe 11, are not positioned directly above one another, as depicted in FIG. 1, but are arranged to be offset from each other such that accepted stock pipe 11 aligns with a central axis of hydrocyclone 1 so that accepted stock pipe 11 is positioned perpendicularly above hydrocyclone 1. Thus, accepted stock connector 3 and feeding connector 2 are provided with connecting directions which are positioned at a right angle to one another. This arrangement may be advantageous in many cases, in particular with regard to compactness of size of the device, simplicity of connectors, and security of mounting hydrocyclone 1 on distribution and collection device 5.

FIG. 5 shows yet another special feature, which is also possible with other contemplated embodiments of the present invention. Accepted stock connector 3 can be shifted in the axial direction by an adjustment device 19, only schematically illustrated here. Thus, even greater tolerances can be compensated. However, this adjustment possibility can be additionally advantageous since it considerably facilitates the construction of the hydrocyclone. In this manner, feeding connector 2 must initially be inserted into feeding pipe 10, for instance. Subsequently, the connection to accepted stock pipe 11 can also be made by raising accepted stock connecter 3. In this way, the use of seals 14 is advantageous as described in FIGS. 3 and 4. Then flanges 6 may be screwed to threaded bolts 9, as described above, and a secure fixing is ensured even without mounting hydrocyclones 1 to an additional mounting.

Figure 6:
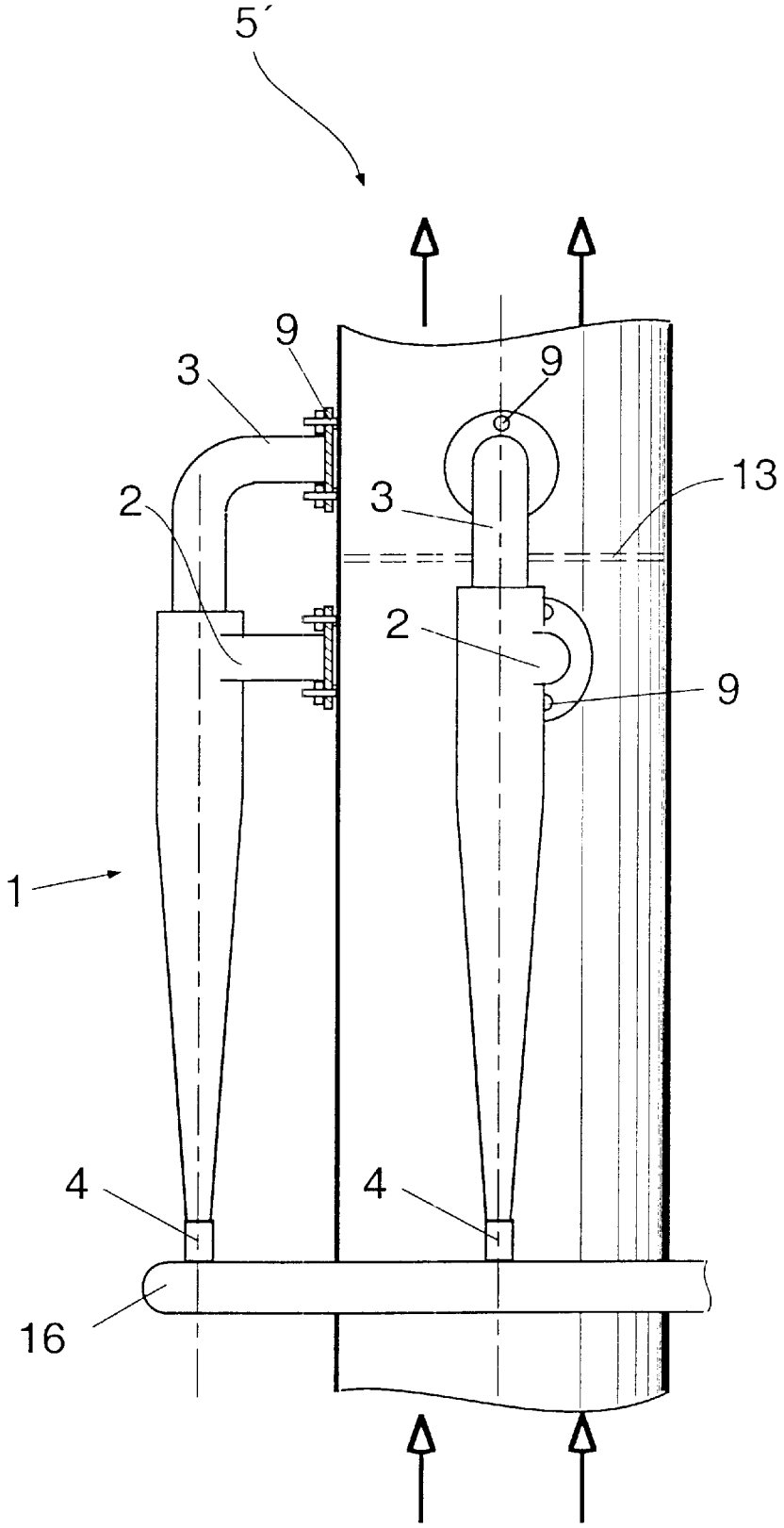

The hydrocyclone device shown in FIG. 6 receives the suspension to be cleaned via a distribution and collection device 5' formed as an upright cylinder. This cylinder is divided perpendicularly to the direction of flow by a horizontal separation wall 13 (drawn in dot-dash lines). Upstream of separation wall 13, i.e., on a feeding side, feeding connectors 2 of hydrocyclones 1 are provided and accepted stock connectors 3 are provided downstream of separation wall 13. A central axis of hydrocyclones 1 are each provided parallel to a central axis of cylindrical side wall 7.

Additionally, hydrocyclones can be used such that the heavy fraction is used as the accepted stock and the light fraction as the rejected stock. By using such an application, e.g., specific light contaminants are separated from a paper stock suspension. In this manner, a device according to features of the present invention can be used in which accepted stock connector 3 depicted in FIG. 1 or 2 can serve as a rejected stock connector. Accepted stock can then be collected at the exit of the heavy fraction. Such switches are known per se and, therefore, they are not specifically shown.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A hydrocyclone device comprising:

at least one hydrocyclone comprising at least one feeding connector, at least one accepted stock connector, and at least one rejected stock connector;

at least one distribution and collection device arranged for feeding fluids into and removing fluids from said at least one hydrocyclone; and at least one flange being arranged on each of said at least one accepted stock connector and said at least one feeding connector, each at least one flange being directly and removably couplable to cylindrical walls of said at least one distribution and collection device via threaded bolts.

2. The hydrocyclone device in accordance with claim 1, wherein the threaded bolts are welded to at least one of the cylindrical walls of said at least one distribution and collection device.

3. The hydrocyclone device in accordance with claim 2, wherein said at least one of the cylindrical walls is not provided with any reinforcements or bores at welding points.

4. The hydrocyclone device in accordance with claim 1, wherein two threaded bolts are associated with each of said at least one accepted stock connector and said feeding connector and wherein the two threaded bolts are mounted to a wall of said at least one distribution and collection device at a point having a shortest distance from said at least one flange.

5. The hydrocyclone device in accordance with claim 1, further comprising at least one seal arranged to surround one of said at least one accepted stock connector and said feeding connector, wherein said at least one seal is insertable into said at least one distribution and collection device such that a portion of said at least one seal is located inside said at least one distribution and collection device and a portion of said at least one seal is located outside of said at least one distribution and collection device.

6. The hydrocyclone device in accordance with claim 5, wherein an outer diameter of said portions of said at least one seal is greater than a diameter of an opening in at least one of the cylindrical walls of said at least one distribution and collection device through which said at least one seal is inserted.

7. The hydrocyclone device in accordance with claim 6, wherein another portion of said at least one seal, which is positionable in said opening of said at least one of the cylindrical walls, has an outer diameter at least about 2 mm smaller than the diameter of said opening.

8. The hydrocyclone device in accordance with claim 7, wherein said at least one seal comprises a bore.

9. The hydrocyclone device in accordance with claim 8, wherein said bore has a cone shape that narrows in an insertion direction.

10. The hydrocyclone device in accordance with claim 1, wherein said flange has a disc surface which, in its mounted position, is not in contact with at least one seal.

11. The hydrocyclone device in accordance with claim 1, wherein at least two of said connectors of said at least one hydrocyclone are positionably adjustable relative to each other and positionably fixable.

12. The hydrocyclone device in accordance with claim 1, wherein a central axis of said at least one hydrocyclone is arranged substantially perpendicularly to a main flow direction in said at least one distribution and collection device.

13. The hydrocyclone device in accordance with claim 1, wherein said at least one distribution and collection device comprises a flow part formed by a closed side wall of one of the cylindrical walls with openings arranged to receive said at least one feeding connector and one of said at least one accepted stock connector and said rejected stock connector, and a separation wall positioned inside said closed side wall to seal a flow cross section, and wherein said at least one feeding connector is arranged upstream of said separation wall, relative to a main flow direction, and said one of said at least one accepted stock connector and said at least one rejected stock connector is arranged downstream of said separation wall, relative to the main flow direction.

14. The hydrocyclone device in accordance with claim 13, wherein said openings for said one of said at least one accepted stock connector and said at least one rejected stock connector are evenly distributed over a circumference of said at least one distribution and collection device.

15. The hydrocyclone device in accordance with claim 13, wherein a central axis of said at least one hydrocyclone is positioned parallel to the main flow direction.

16. The hydrocyclone device in accordance with claim 13, wherein said side wall has a cross-section of a regular polygon.

17. The hydrocyclone device in accordance with claim 1, wherein said at least one hydrocyclone comprises a plurality of hydrocyclones, in which each of said plurality of hydrocyclones include at least one feeding connector, at least one accepted stock connector, and at least one rejected stock connector.

18. The hydrocyclone device in accordance with claim 17, wherein said at least one distribution and collection device comprises at least one feeding pipe, arranged to feed fluids to be cleaned to said plurality of hydrocyclones, and at least one accepted stock pipe, arranged to remove accepted stock from said plurality of hydrocyclones.

19. The hydrocyclone device in accordance with claim 1, wherein said at least one flange comprises a plurality of flanges which are removably couplable to said at least one distribution and collection device, and wherein each of said plurality of flanges is mounted to each of said at least one feeding connector and at least one accepted stock connector.

20. The hydrocyclone device in accordance with claim 19, wherein two threaded bolts are coupled to said at least one distribution and collection device to mount each of said plurality of flanges.

21. The hydrocyclone device in accordance with claim 1, wherein one at least one flange comprises a round disk shape.

22. The hydrocyclone device in accordance with claim 1, wherein one at least one flange comprises an oval shape.

23. The hydrocyclone device in accordance with claim 1, wherein each at least one flange has a different shape.

24. The hydrocyclone device in accordance with claim 1, wherein each at least one flange has the same shape.

25. The hydrocyclone device in accordance with claim 1, wherein said at least one distribution and collection device comprises at least one feeding pipe, arranged to feed fluids to be cleaned to said plurality of hydrocyclones, and at least one accepted stock pipe, arranged to remove accepted stock from said plurality of hydrocyclones.

26. The hydrocyclone device in accordance with claim 25, wherein said at least one feeding pipe and said at least one accepted stock pipe are aligned one above the other.

27. The hydrocyclone device in accordance with claim 26, wherein said at least one feeding pipe is arranged below said at least one accepted stock pipe.

28. The hydrocyclone device in accordance with claim 25, wherein stock flows out of said at least one feeding pipe in a direction substantially parallel to a direction at which stock flows into said at least one accepted stock pipe.

29. The hydrocyclone device in accordance with claim 25, wherein stock flows out of said at least one feeding pipe in a direction substantially perpendicular to a direction at which stock flows into said at least one accepted stock pipe.

30. An apparatus for cleaning a fluid comprising:

a plurality of hydrocyclones, each hydrocyclone comprising a feeding connector and an accepted stock connector;

a feed pipe for supplying the fluid to be cleaned;

an accepted stock pipe for removing the cleaned fluid;

flanges coupled to said feeding connector and to said accepted stock connector, wherein said flanges are directly and removably couplable to a cylindrical wall of said feed pipe and to a cylindrical wall of said accepted stock pipe via threaded bolts.

31. The apparatus in accordance with claim 30, wherein each hydrocyclone further comprises a rejected stock connector, and said apparatus further comprises a rejected stock pipe coupled to said rejected stock connector.

32. A hydrocyclone device comprising:

at least one hydrocyclone comprising at least one feeding connector, at least one accepted stock connector, and at least one rejected stock connector;

at least one distribution and collection device arranged for feeding fluids into and removing fluids from said at least one hydrocyclone;

at least one flange coupled to at least one of said at least one feeding connector, said at least one accepted stock connector, and said at least one rejected stock connector, which is removably couplable to said at least one distribution and collection device; and at least one seal arranged to surround one of said at least one accepted stock connector and said feeding connector, wherein said at least one seal is insertable into said at least one distribution and collection device such that a portion of said at least one seal is located inside said at least one distribution and collection device and a portion of said at least one seal is located outside of said at least one distribution and collection device, and wherein said at least one seal comprises a bore.

33. The hydrocyclone device in accordance with claim 32, wherein said bore has a cone shape that narrows in an insertion direction.

* * * * *